US011892214B2

(12) United States Patent
Shen et al.

(10) Patent No.: US 11,892,214 B2
(45) Date of Patent: Feb. 6, 2024

(54) OUTDOOR UNIT AND HEAT PUMP SYSTEM

(71) Applicant: CARRIER CORPORATION, Palm Beach Gardens, FL (US)

(72) Inventors: Guangyu Shen, Shanghai (CN); Hui Zhai, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 387 days.

(21) Appl. No.: 17/125,082

(22) Filed: Dec. 17, 2020

(65) Prior Publication Data

US 2021/0318045 A1 Oct. 14, 2021

(30) Foreign Application Priority Data

Apr. 9, 2020 (CN) ..... 202010273706.0

(51) Int. Cl.

| | |
|---|---|
| ***F25B 49/02*** | (2006.01) |
| ***F25B 41/20*** | (2021.01) |
| ***F25B 30/02*** | (2006.01) |
| ***F25B 41/40*** | (2021.01) |

(52) U.S. Cl.

CPC ..... *F25B 49/02* (2013.01); *F25B 30/02* (2013.01); *F25B 41/20* (2021.01); *F25B 41/40* (2021.01); *F25B 2600/2515* (2013.01); *F25B 2600/2519* (2013.01)

(58) Field of Classification Search

CPC ..... F25B 49/02; F25B 41/20; F25B 41/40; F25B 30/02; F25B 2600/2515; F25B 2600/2519

See application file for complete search history.

(56) References Cited

U.S. PATENT DOCUMENTS

| | | | | |
|---|---|---|---|---|
| 2005/0044861 | A1* | 3/2005 | Cho | F25B 13/00 62/81 |
| 2011/0232308 | A1* | 9/2011 | Morimoto | F25B 13/00 62/278 |
| 2016/0245540 | A1* | 8/2016 | Koge | F24F 3/06 |
| 2016/0320100 | A1* | 11/2016 | Okano | F24F 1/06 |
| 2016/0363376 | A1* | 12/2016 | Aaron | F28F 25/06 |

* cited by examiner

*Primary Examiner* — Nael N Babaa

(74) *Attorney, Agent, or Firm* — CANTOR COLBURN LLP

(57) ABSTRACT

The present application provides an outdoor unit and a heat pump system. The outdoor unit includes a compressor, a valve assembly, an outdoor heat exchanger, a first pipeline port and a second pipeline port; a first branch that connects the valve assembly and the first pipeline port, the first branch being provided with the outdoor heat exchanger and a first switch valve assembly; a second branch that connects the mode switch valve assembly and the first pipeline port, wherein the second branch is provided with a second switch valve assembly; a third branch that connects the second pipeline port and the refrigerant inlet of the outdoor heat exchanger. The first and second switch valve assemblies control the on and off of the first branch and the second branch so that the refrigerant flows through the refrigerant inlet and the refrigerant outlet of the outdoor heat exchanger.

8 Claims, 3 Drawing Sheets

OUTDOOR UNIT AND HEAT PUMP SYSTEM

CROSS-REFERENCE TO RELATED APPLICATIONS

This application claims the benefit of Chinese Application No. 202010273706.0 filed Apr. 9, 2020, the disclosure of which is incorporated herein by reference in its entirety.

BACKGROUND

The present application relates to the field of equipment for air conditioning and refrigeration and freezing. More particularly, the present application relates to an outdoor unit and a heat pump system for refrigeration and heating.

At present, heat pump systems are systems with mature technologies that are widely applied, which can be used in the sanitary hot water and heating fields, as well as in the air conditioning field in homes or commercial buildings. This type of heat pump system usually consists of an outdoor unit and an indoor unit. As the name suggests, the outdoor unit is usually arranged outside the space whose temperature is to be regulated, so it has relatively low requirements on noise, appearance, volume, etc. Therefore, multiple components necessary for the heat pump system can be arranged in the outdoor unit, such as compressor, outdoor heat exchanger, etc. Among them, for a type of outdoor heat exchange unit, it can make use of the outdoor ambient air temperature to dissipate heat directly. In order to improve the heat dissipation effect, it is generally desired that the refrigerant in the heat exchanger and the outdoor air that is forced by the fan to flow through the outdoor heat exchanger are in a contra-flow form. In other words, after the flow direction of the refrigerant in the heat exchanger is disassembled into a first direction vector perpendicular to the air flow direction and a second direction vector parallel to the air flow direction, the second direction vector thereof is opposite to the air flow direction. However, since the heat pump system changes the flow direction of the refrigerant during refrigeration and heating, it is difficult to ensure that the refrigerant can flow through the heat exchanger in a desired direction in various modes.

BRIEF DESCRIPTION

The present invention provides an outdoor unit and a heat pump system to improve the heat dissipation efficiency of the outdoor unit of the system.

In order to achieve at least one objective of the present application, according to one aspect of the present application, an outdoor unit is provided, which comprises: a compressor, a mode switch valve assembly, an outdoor heat exchanger having a refrigerant inlet and a refrigerant outlet connected through pipelines, and a first pipeline port and a second pipeline port for docking with an indoor unit; a first branch that connects the mode switch valve assembly and the first pipeline port, wherein the first branch is provided with the outdoor heat exchanger and a first switch valve assembly disposed on the refrigerant inlet side; a second branch that connects the mode switch valve assembly and the first pipeline port, wherein the second branch is provided with a second switch valve assembly and is connected in parallel with the outdoor heat exchanger; a third branch that connects the second pipeline port and the refrigerant inlet of the outdoor heat exchanger; wherein, the first switch valve assembly and the second switch valve assembly are configured to control the on and off of the first branch and the second branch when the mode switch valve assembly arbitrarily switches the refrigerant flow direction, so that the refrigerant flows through the refrigerant inlet and the refrigerant outlet of the outdoor heat exchanger in sequence.

Optionally, in the first switch state of the mode switch valve assembly, the pipelines connect the compressor, the mode switch valve assembly, and the first pipeline port; and the pipelines connect the second pipeline port, the third branch, the outdoor heat exchanger inlet and the outdoor heat exchanger outlet on the first branch, the second branch, the mode switch valve assembly, and the compressor. In the second switch state of the switch valve assembly, the pipelines connect the compressor, the mode switch valve assembly, the outdoor heat exchanger inlet and the outdoor heat exchanger outlet on the first branch, and the first pipeline port; and the pipelines connects the second pipeline port, the mode switch valve assembly, and the compressor.

Optionally, the switch valve assembly has a first port connected to the exhaust port of the compressor, a second port connected to the suction port of the compressor, a third port connected to the outdoor heat exchanger, and a fourth port connected to the second pipeline port, wherein the first port is controlledly switched to be connected to the third port or the fourth port, and the second port is controlledly switched to be connected to the fourth port or the third port accordingly.

Optionally, the outdoor unit further comprises a heat exchange fan arranged on a first side of the outdoor heat exchanger, wherein the refrigerant flow direction of the outdoor heat exchanger is arranged in a staggered manner with the flow direction of the air driven by the heat exchange fan, and the refrigerant outlet is closer to the upstream of the flow direction of the air driven by the heat exchange fan than the refrigerant inlet.

Optionally, the outdoor heat exchanger is configured as a tube-fin heat exchanger.

Optionally, the first switch valve assembly and the second switch valve assembly are configured as a first check valve and a second check valve with opposite stop directions.

Optionally, the third branch is further provided with a third switch valve assembly, and the first branch is further provided with a fourth switch valve assembly disposed on the refrigerant outlet side, wherein the fourth switch valve assembly and the third switch valve assembly are alternatively turned on. A fourth branch connects the mode switch valve assembly and the first pipeline port, and the fourth branch is provided with a fifth switch valve assembly. And, a fifth branch connects the mode switch valve assembly and the second pipeline port, and the fifth branch is provided with a sixth switch valve assembly, wherein the fifth switch valve assembly and the sixth switch valve assembly are alternatively turned on.

Optionally, the third switch valve assembly and the fourth switch valve assembly are configured as a third check valve and a fourth check valve with opposite stop directions; and/or the fifth switch valve assembly and the sixth switch valve assembly are configured as a fifth check valve and a sixth check valve with opposite stop directions.

In order to achieve at least one objective of the present application, according to another aspect of the present application, a heat pump system is provided, which comprises the outdoor unit as described above; and an indoor unit having indoor heat exchangers and throttle assemblies connected through pipelines, and a third pipeline port and a fourth pipeline port for docking with the outdoor unit.

Optionally, the heat pump system further comprises: a heat exchange scheduling unit having a seventh switch valve assembly and an eighth switch valve assembly connected in parallel, and a plurality of three-way valve assemblies. Among them, each of the three-way valve assemblies is connected to the second pipeline port, the third pipeline port, and the first pipeline port, respectively; the first end of the seventh switch valve assembly is connected to the fourth pipeline port, the second end of the seventh switch valve assembly is connected between the plurality of three-way valve assemblies and the first pipeline port; and the first end of the eighth switch valve assembly is connected to the fourth pipeline port, and the second end of the eighth switch valve assembly is connected between the plurality of three-way valve assemblies and the second pipeline port.

According to the outdoor unit and the heat pump system of the present application, with the cooperation of the first branch, the second branch, and the third branch, and by controlling the on and off of the first switch valve assembly and the second switch valve assembly, the refrigerant in any mode can flow through the refrigerant inlet and the refrigerant outlet of the outdoor heat exchanger in a predetermined sequence, thereby effectively improving the heat dissipation efficiency of the outdoor unit of the system.

DETAILED DESCRIPTION

The present application will be described in detail hereinafter with reference to the exemplary embodiments shown in the accompanying drawings. However, it should be understood that the present application can be implemented in many different forms, and should not be construed as being limited to the embodiments set forth herein. These embodiments are provided here for the purpose of making the disclosure of the present application more complete and comprehensive, and fully conveying the concept of the present application to those skilled in the art.

In addition, for any single technical feature described or implied in the embodiments mentioned herein, or any single technical feature displayed or implied in each drawing, the present application still allows any continued arbitrary combination or deletion of these technical features (or the equivalents thereof) without any technical obstacles, thereby obtaining more other embodiments of the present application that may not be directly mentioned herein.

Figure 1:
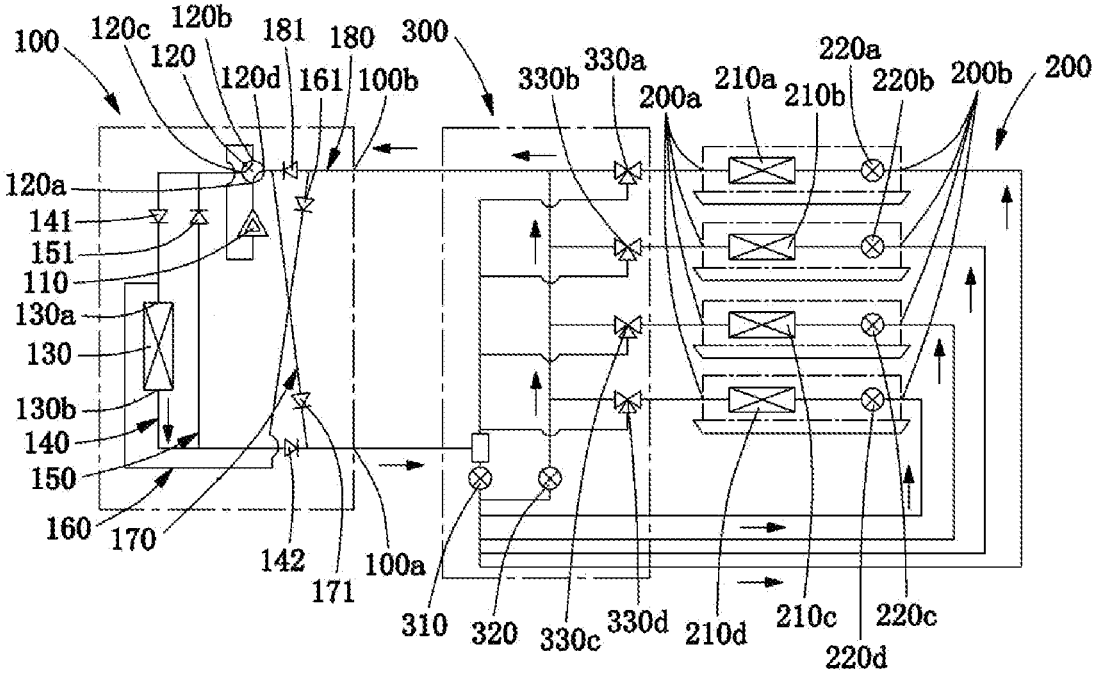
FIG. 1 is a schematic diagram of an embodiment of the heat pump system of the present application in a refrigeration mode.

Referring to FIG. 1, an embodiment of the heat pump system according to the present application is shown, which comprises an embodiment of the outdoor unit according to the present application, as well as the indoor unit and the heat exchange scheduling unit. They will be described in sequence below.

First, referring to the outdoor unit 100 shown in the figure, it comprises components such as a compressor 110, a mode switch valve assembly 120, and an outdoor heat exchanger 130 having a refrigerant inlet 130*a* and a refrigerant outlet 130*b* connected through pipelines, and a first pipeline port 100*a* and the second pipeline port 100*b* for docking with an indoor unit 200. In addition, part of the pipelines used to connect these components or ports are formed as the following branches: a first branch 140 connected between the mode switch valve assembly 120 and the first pipeline port 100*a*, wherein the first branch 140 is provided with the outdoor heat exchanger 130 as described above and a first switch valve assembly 141 disposed on the side of the refrigerant inlet 130*a*; a second branch 150 also connected between the mode switch valve assembly 120 and the first pipeline port 100*a*, wherein the second branch 150 is provided with a second switch valve assembly 151 connected in parallel with the outdoor heat exchanger 130; and a third branch 160 connected between the second pipeline port 100*b* and the refrigerant inlet 130*a* of the outdoor heat exchanger 130. Among them, the first switch valve assembly 141 and the second switch valve assembly 151 are configured to control the on and off of the first branch 140 and the second branch 150 when the mode switch valve assembly 120 arbitrarily switches the refrigerant flow direction, so that the refrigerant flows through the refrigerant inlet 130*a* and the refrigerant outlet 130*b* of the outdoor heat exchanger 130 in sequence.

According to the outdoor unit of the present application under this configuration, with the cooperation of the first branch, the second branch, and the third branch, and by controlling the on and off of the first switch valve assembly and the second switch valve assembly, the refrigerant in any mode can flow through the refrigerant inlet and the refrigerant outlet of the outdoor heat exchanger in a predetermined sequence, thereby effectively improving the heat dissipation efficiency of the outdoor unit of the system.

The following will exemplify the possible improvements made to the various components of the outdoor unit of the heat pump system, and these improvements can further improve the energy efficiency or reliability, and the like, of the unit.

For example, in the first switch state of the mode switch valve assembly 120, the pipelines can be used to connect the compressor 110, the mode switch valve assembly 120, and the first pipeline port 100*a*; and the pipelines can be used to connect the second pipeline port 100*b*, the third branch 160, the inlet of the outdoor heat exchanger 130 and the outlet of the outdoor heat exchanger 130 on the first branch 140, the second branch 150, the mode switch valve assembly 120 and the compressor 110. As a result, the high-temperature and high-pressure gas discharged from the compressor 110 can flow into the docked indoor unit through the mode switch valve assembly 120 and the first pipeline port 100*a*, thereby realizing the heating function in at least part of the indoor unit, and enabling the refrigerant that has completed heating in part of the indoor unit to flow into the outdoor heat exchanger 130 on the first branch 140 sequentially through the second pipeline port 100*b* and the third branch 160 in a predetermined direction to absorb heat, and then return to the compressor 110 through the second branch 150 and the mode switch valve assembly 120.

For another example, in the second switch state of the switch valve assembly, the pipelines can be used to connect the compressor 110, the mode switch valve assembly 120, the inlet of the outdoor heat exchanger 130 and the outlet of the outdoor heat exchanger 130 on the first branch 140, and the first pipeline port 100*a*; and the pipelines can be used to connect the second pipeline port 100*b*, the mode switch valve assembly 120 and the compressor 110. As a result, the high-temperature and high-pressure gas discharged from the compressor 110 can flow into the outdoor heat exchanger 130 on the first branch 140 through the mode switch valve assembly 120 in a predetermined direction to dissipate heat, and the heat-dissipated refrigerant flows into the docked indoor unit through the first pipe port 100*a*, thereby realizing the refrigeration function in at least part of the indoor unit, and enabling the refrigerant that has completed refrigeration in part of the indoor unit to return to the compressor 110 sequentially through the second pipeline port 100*b* and the mode switch valve assembly 120.

Specifically, in order to realize the flow path switch function of the aforementioned switch valve assemblies, a more mature switch valve assembly, namely a four-way valve assembly, is provided here, which is connected to the flow path of the present application as follows to realize the aforementioned switch function. Specifically, the switch valve assembly has a first port 120*a* connected to the exhaust port of the compressor 110, a second port 120*b* connected to the suction port of the compressor 110, a third port 120*c* connected to the outdoor heat exchanger 130, and a fourth port 120*d* connected to the second pipeline port 100*b*, wherein the first port 120*a* is controlledly switched to be connected to the third port 120*c* or the fourth port 120*d*, and the second port 120*b* is controlledly switched to be connected to the fourth port 120*d* or the third port 120*c* accordingly.

Of course, it should be understood that the mode switch valve assembly mentioned in the present application can be a single valve as described above, or a combination of multiple valves, as long as the mode switch valve assembly can switch the pipelines between the aforementioned components to make them circulate as needed. As for the specific connection modes, there can be multiple, and the present embodiment provides one of the preferred solutions. However, according to the teachings and exemplary embodiments of the present application about the functions to be performed by the switch valve assemblies of the flow paths, those skilled in the art can easily modify or adjust the connection mode thereof, and such modifications or adjustments should be included in the protection scope of the present application.

For yet another example, in order to further diversify the switch of system flow path so as to achieve more coordinating functions for refrigeration/heating, the third branch 160 may further be provided with a third switch valve assembly 161, and the first branch 140 may be provided with a fourth switch valve assembly 142 on the side of the refrigerant outlet 130*b*, wherein the fourth switch valve assembly 142 and the third switch valve assembly 161 are alternatively turned on. These switch valve assemblies further regulate the source of the refrigerant before it flows into the outdoor heat exchanger or the whereabouts of the refrigerant after it flows out of the outdoor heat exchanger, so as to adjust the flow of the refrigerant in the entire system.

Similarly, a fourth branch 170 can further be provided, which is connected between the mode switch valve assembly 120 and the first pipeline port 100*a*, and a fifth switch valve assembly 171 is provided on the fourth branch 170. And, a fifth branch 180 is connected between the mode switch valve assembly 120 and the second pipeline port 100*b*, and a sixth switch valve assembly 181 is further provided on the fifth branch 180. Among them, the fifth switch valve assembly 171 and the sixth switch valve assembly 181 are turned on alternatively. These switch valve assemblies further regulate the source of the refrigerant before it flows into the compressor or the whereabouts of the refrigerant after it flows out of the compressor, so as to adjust the flow of the refrigerant in the entire system.

For further another example, in order to simplify the on and off control of the aforementioned branches, the switch valve assemblies involved can be configured as check valves with specific stop directions, so that while the on and off control requirements are met, the requirements about the control program in the controller is reduced, and the system reliability is improved.

For example, the first switch valve assembly 141 and the second switch valve assembly 151 can be configured as a first check valve 141 and a second check valve 151 with opposite stop directions. At this time, when the refrigerant flows directly from the exhaust port of the compressor 110 to the outdoor heat exchanger 130, it will definitely flow into the inlet 130*a* of the outdoor heat exchanger 130 through the first check valve 141; and if the refrigerant flows from the indoor unit side to the suction port of the compressor 110, it will definitely pass through the outlet 130*b* of the outdoor heat exchanger 130 and the second check valve 151, and then flow to the suction port of the compressor 110.

As another example, the third switch valve assembly 161 and the fourth switch valve assembly 142 may be configured as a third check valve 161 and a fourth check valve 142 with opposite stop directions. At this time, when the refrigerant flows directly from the outlet 130*b* of the outdoor heat exchanger 130 to the indoor unit side, it will definitely flow through the fourth check valve 142; and if the refrigerant flows back to the inlet 130*a* of the outdoor heat exchanger 130 from the indoor unit side, it will definitely pass through the third check valve 161.

As yet another example, the fifth switch valve assembly 171 and the sixth switch valve assembly 181 may be configured as a fifth check valve 171 and a sixth check valve 181 with opposite stop directions. At this time, when the refrigerant flows directly from the exhaust port of the compressor 110 to the indoor unit side, it will definitely pass through the fifth check valve 171; and if the refrigerant flows back to the suction port of the compressor 110 from the indoor unit side, it will definitely pass through the sixth check valve 181.

Figure 5:
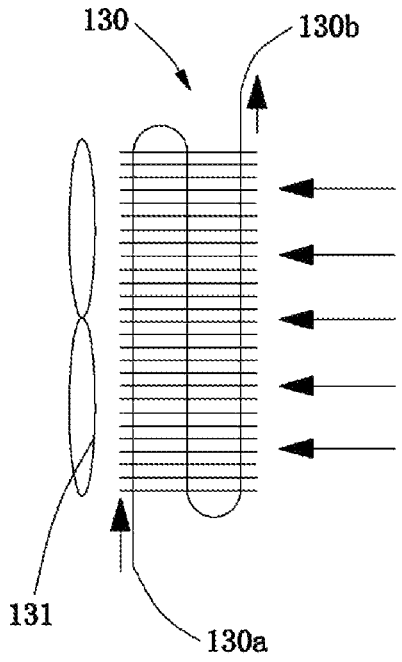
FIG. 5 is a schematic diagram of the arrangement of the outdoor heat exchanger and fan of the present application.

Optionally, after the flow path design ensures that the refrigerant can flow through the outdoor heat exchanger 130 in a predetermined direction, certain improvements can also be made to the arrangement of the outdoor heat exchanger itself, so as to further improve its heat exchange efficiency. Specifically, as shown in FIG. 5, after the heat exchange fan 131 is arranged on a first side of the outdoor heat exchanger 130, the arrangement of the outdoor heat exchanger 130 can be adjusted so that the flow direction of the refrigerant in the heat exchanger is arranged in a staggered manner with the flow direction of the air driven by the heat exchange fan 131, and the refrigerant outlet 130*b* is closer to the upstream of the flow direction of the air driven by the heat exchange fan 131 than the refrigerant inlet 130*a*. In other words, after the direction vector pointing from the inlet to the outlet of the heat exchanger (that is, the complete flow path of the refrigerant in the heat exchanger) is disassembled into a first direction vector perpendicular to the air flow direction and a second direction vector parallel to the air flow direction, the second direction vector thereof is opposite to the air flow direction, thereby forming a "contra-flow" heat exchanger as designed in the embodiment of the present application. It has been found through experiments that refrigerant in this type of heat exchanger has a better heat exchange effect with the air flow than in the "uniflow type" or other type of heat exchangers.

Of course, FIG. 5 shows only one form of "contra-flow" heat exchangers. Based on the teachings of the foregoing embodiments, those skilled in the art can make corresponding modifications. For example, the heat exchanger pipelines are arranged in a parallel zigzag pattern with the left side in and the right side out; or, the heat exchanger pipelines are arranged in a slanted zigzag pattern with the left side in and the right side out; or, the heat exchanger pipelines as a whole is in a spiral arrangement with the left side in and the right side out, etc., as long as it essentially meets the aforementioned requirements.

Of course, in order to better realize the heat exchange effect with the air flow, the outdoor heat exchanger 130 can usually be configured as a tube-fin heat exchanger.

In addition, with continued reference to FIG. 1, in addition to the outdoor unit 100 in any of the foregoing embodiments or combinations thereof, the heat pump system further comprises an indoor unit 200. The indoor unit 200 has indoor heat exchangers 210*a*, 210*b*, 210*c*, 210*d* and throttle assemblies 220*a*, 220*b*, 220*c*, 220*d* connected through pipelines, and a third pipeline port 200*a* and a fourth pipeline port 200*b* for docking with the outdoor unit 100. Among them, it should be understood that there may be one or more indoor heat exchangers, and there should be a corresponding number of throttle assemblies to realize throttling of each of the indoor heat exchangers, respectively. Of course, when it is unnecessary to realize the throttling function, the throttle assemblies can also be simply used as the executive elements for turning on and off the pipelines where the indoor heat exchanger(s) are currently located. The heat pump system under this configuration can effectively utilize the high heat-dissipation efficiency brought about by the flow path design of the outdoor unit as mentioned above, thereby improving the performance of the entire system, such as reducing energy consumption or improving heat exchange efficiency.

Optionally, the heat pump system further comprises a heat exchange scheduling unit 300. The heat exchange scheduling unit 300 has a seventh switch valve assembly 310 and an eighth switch valve assembly 320 connected in parallel, and a plurality of three-way valve assemblies 330*a*, 330*b*, 330*c*, and 330*d*. Among them, it should be understood that the number of the three-way valve assemblies mainly depends on the number of indoor heat exchange flow paths in the corresponding indoor unit, so as to achieve the purpose of using each of the three-way valve assemblies to control the flow direction of the corresponding indoor heat exchange flow path. And, the seventh switch valve assembly 310 and the eighth switch valve assembly 320 also, by controlling the on and off of the flow paths, jointly achieve the purpose of independently switching the flow direction of each of the indoor heat exchange flow paths together with the three-way valve assemblies. Specifically, in order to control the flow direction of each of the indoor heat exchange flow paths, each of the three-way valve assemblies 330*a*, 330*b*, 330*c*, 330*d* can be arranged to be connected to the second pipeline port 100*b*, the third pipeline port 200*a* and the first pipeline port 100*a*, respectively; the first end of the seventh switch valve assembly 310 is connected to the fourth pipeline port 200*b*, and the second end of the seventh switch valve assembly 310 is connected between a plurality of three-way valve assemblies 330*a*, 330*b*, 330*c*, 330*d* and the first pipeline port 100*a*; and the first end of the eighth switch valve assembly 320 is connected to the fourth pipeline port 200*b*, and the second end of the eighth switch valve assembly 320 is connected between a plurality of three-way valve assemblies 330*a*, 330*b*, 330*c*, 330*d* and the second pipeline port 100*b*.

According to the foregoing arrangement, it can be seen that in the connection of components forming the refrigeration cycle, there may be multiple throttle assemblies between any two heat exchangers. In order to meet the temperature conditioning and throttling requirements of different heat exchangers in the indoor unit, as an implementation scheme, the throttle assembly close to the heat exchanger used as a condenser can be kept fully open, while the throttle assembly close to the heat exchanger used as an evaporator is adjusted as to its opening to provide a throttling effect. This point can be understood more clearly through the description of the system operation status in various modes provided later.

For another example, the aforementioned throttle assemblies may either use a single electronic expansion valve, or a single thermal expansion valve, or a parallel combination of an electronic expansion valve and a check valve. The choice of these throttle assemblies mainly stems from the control accuracy requirements or cost considerations of the current units.

Furthermore, although not mentioned in the figures, other conventional components can also be provided in the system in order to further improve system reliability or performance. These components can be some devices. For example, a gas-liquid separator can be arranged at the suction port of the compressor to perform gas-liquid separation, so as to prevent the compressor from liquid hammer. For another example, an oil separator, and also solenoid valves and capillary tubes in the corresponding flow paths can be arranged at the exhaust port of the compressor, such that the lubricating oil carried by the refrigerant can be recovered and the refrigerant can be prevented from being sucked in. For still another example, oil heating wires can be arranged in the compressor to heat the lubricating oil to improve its viscosity. These components can also be some sensors and control equipment, such as a low pressure sensor, a suction temperature sensor, and a low pressure switch arranged at the suction port of the compressor, or an exhaust temperature sensor, a high pressure sensor, and a high pressure switch arranged at the exhaust port of the compressor, and so on. Since the application of these components in this field is very mature, and they are all aimed at realizing their basic functions, they will not be described in detail here.

Combining the possibilities of the connection relationships of the various components and the switch of pipelines in the foregoing embodiments, the heat pump system can operate a variety of refrigeration modes and heating modes for different purposes. Part of the refrigeration modes and heating modes that can be operated by the heat pump system will be described in conjunction with the appended drawings and the actions of each component in the heat pump system.

Referring to FIG. 1, when all the indoor heat exchangers in the indoor unit of the heat pump system operate the refrigeration mode, in the outdoor unit, the switch valve assembly is adjusted to the second switch state. At this time, the first port 120*a* of the mode switch valve assembly 120 is connected to the third port 120*c*, and the second port 120*b* of the mode switch valve assembly 120 is connected to the fourth port 120*d*; in the heat exchange scheduling unit 300, the seventh switch valve assembly 310 is turned on, and the eighth switch valve assembly 320 is turned off, and each of the three-way valve assemblies 330*a*, 330*b*, 330*c*, 330*d* is switched to be connected to the third pipeline port 200*a* of the indoor heat exchangers 210*a*, 210*b*, 210*c*, 210*d* and the second pipeline port 100*b* of the outdoor unit, respectively. At this time, the high-temperature and high-pressure refrigerant discharged from the compressor 110 can flow into the outdoor heat exchanger 130 on the first branch 140 through the mode switch valve assembly 120 in a predetermined direction to dissipate heat, and the heat-dissipated refrigerant flows into the docked heat exchange scheduling unit 300 and the indoor unit 200 through the fourth check valve 142 and the first pipeline port 100*a*. The refrigerant flows through each of the throttle assemblies 220*a*, 220*b*, 220*c*, 220*d* through the seventh switch valve assembly 310 that is turned-on for throttling expansion, and then enter each of the indoor heat exchangers 210*a*, 210*b*, 210*c*, 210*d* to be evaporated and absorb heat. The refrigerant that has completed the refrigeration conditioning flows back into the outdoor unit 100 through the third pipeline port 200*a*, each of the three-way valve assemblies 330*a*, 330*b*, 330*c*, 330*d*, and the second pipeline port 100*b*, and then flows back into the compressor 110 through the sixth check valve 181 and the mode switch valve assembly 120.

Figure 2:
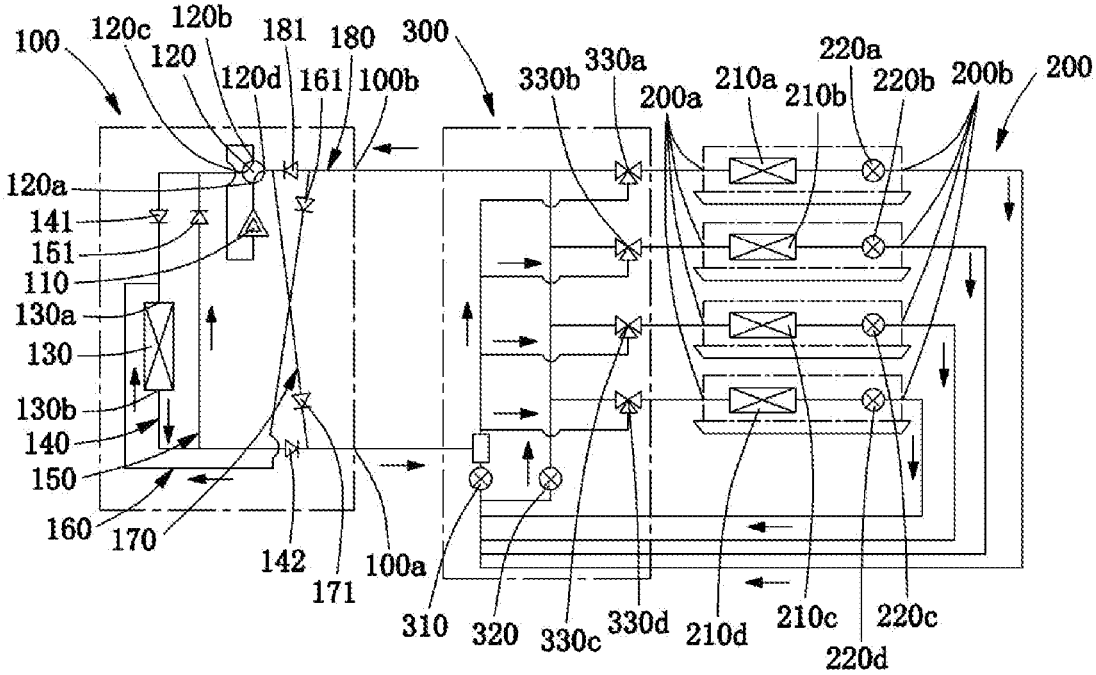
FIG. 2 is a schematic diagram of an embodiment of the heat pump system of the present application in a heating mode.

Referring to FIG. 2, when all the indoor heat exchangers in the indoor unit of the heat pump system operate the heating mode, in the outdoor unit, the switch valve assembly is adjusted to the first switch state. At this time, the first port 120*a* of the mode switch valve assembly 120 is connected to the fourth port 120*d*, and the second port 120*b* of the mode switch valve assembly 120 is connected to the third port 120*c*; in the heat exchange scheduling unit 300, the seventh switch valve assembly 310 is turned off, and the eighth switch valve assembly 320 is turned on, and each of the three-way valve assemblies 330*a*, 330*b*, 330*c*, 330*d* is switched to be connected to the third pipeline port 200*a* of the indoor heat exchangers 210*a*, 210*b*, 210*c*, 210*d* and the first pipeline port 100*a* of the outdoor unit, respectively. At this time, the high-temperature and high-pressure refrigerant discharged from the compressor 110 can flow into the docked heat exchange scheduling unit 300 and the indoor unit 200 through the mode switch valve assembly 120, the fifth check valve 171 and the first pipeline port 100*a*. The refrigerant flows into each of the indoor heat exchangers 210*a*, 210*b*, 210*c*, 210*d* through each of the three-way valve assemblies 330*a*, 330*b*, 330*c*, 330*d* and the third pipeline port 200*a* to be condensed and release heat. And, the refrigerant that has completed heating flows through each of the throttle assemblies 220*a*, 220*b*, 220*c*, 220*d* for throttling expansion, and then flows back to the outdoor unit 100 through the fourth pipeline port 200*b*, the eighth switch valve assembly 320 that is turned on, and the second pipeline port 100*b*. The refrigerant then flows into the outdoor heat exchanger 130 on the first branch 140 through the third check valve 161 on the third branch 160 in a predetermined direction to absorb heat, and the refrigerant that has absorbed heat flows back into the compressor through the second check valve 151 and the mode switch valve assembly 120.

Figure 3:
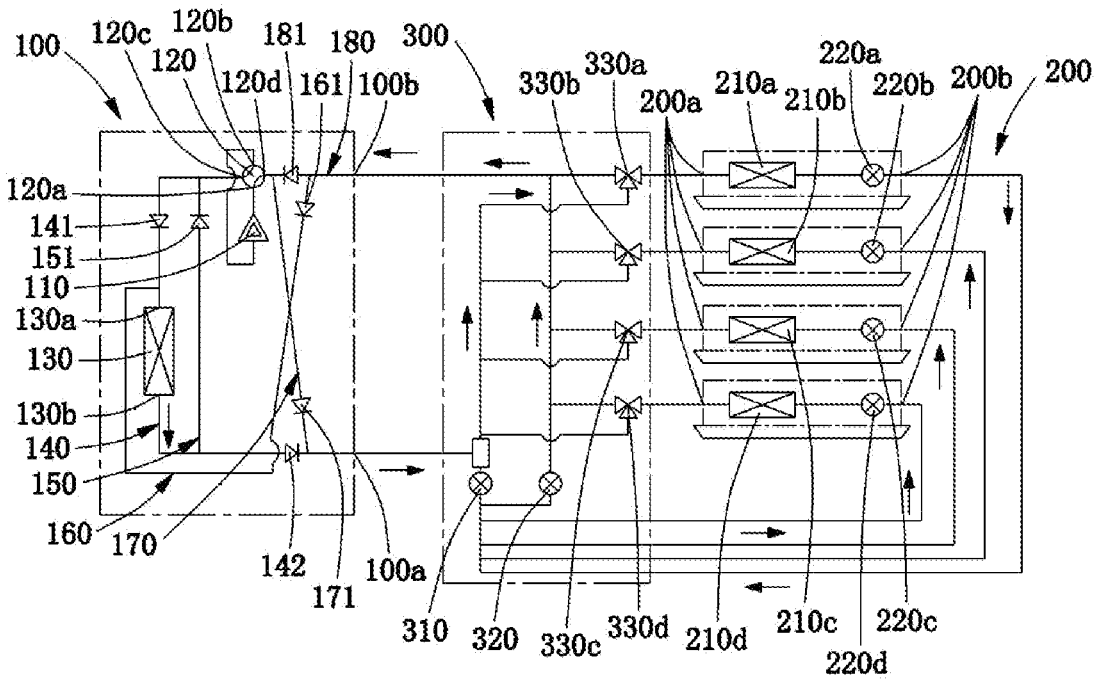
FIG. 3 is a schematic diagram of an embodiment of the heat pump system of the present application in a main refrigeration mode.

Referring to FIG. 3, when the heat pump system operates the main refrigeration mode, that is, part of the indoor heat exchangers in the indoor unit thereof operate the refrigeration mode, the other part of the indoor heat exchangers in the indoor unit thereof operate the heating mode, and the outdoor heat exchanger is used for heat dissipation, in the outdoor unit, the switch valve assembly is adjusted to the second switch state. At this time, the first port 120*a* of the mode switch valve assembly 120 is connected to the third port 120*c*, and the second port 120*b* of the mode switch valve assembly 120 is connected to the fourth port 120*d*; in the heat exchange scheduling unit 300, the seventh switch valve assembly 310 and the eighth switch valve assembly 320 are turned off, and part of the three-way valve assemblies 330*a*, 330*b*, 330*c*, 330*d*, i.e., the three-way valve assembly 330*a* is switched to be connected to the third pipeline port 200*a* of the indoor heat exchanger 210*a* and the first pipeline port 100*a* of the outdoor unit, respectively, and the remaining three-way valve assemblies 330*b*, 330*c*, 330*d* are switched to be connected to the third pipeline port 200*a* of the indoor heat exchangers 210*b*, 210*c*, 210*d* and the second pipeline port 100*b* of the outdoor unit, respectively. At this time, the high temperature and high pressure refrigerant discharged from the compressor 110 can flow into the outdoor heat exchanger 130 on the first branch 140 through the mode switch valve assembly 120 in a predetermined direction to dissipate heat, and the heat-dissipated refrigerant flows into the docked heat exchange scheduling unit 300 and the indoor unit 200 through the fourth check valve 142 and the first pipeline port 100*a*. The refrigerant flows into the indoor heat exchanger 210*a* through the three-way valve assembly 330*a* and the third pipeline port 200*a* to be condensed and release heat. And, the refrigerant that has completed heating then flows from the fourth pipeline port 200*b* to each of the throttle assemblies 220*b*, 220*c*, 220*d* for throttling expansion, and then enters the indoor heat exchangers 210*b*, 210*c*, and 210*d* to be evaporated and absorb heat. The refrigerant that has completed refrigeration conditioning flows back to the outdoor unit 100 through the third pipeline port 200*a*, each of the three-way valve assemblies 330*b*, 330*c*, 330*d*, and the second pipeline port 100*b*, and flows back to the compressor 110 through the sixth check valve 181 and the mode switch valve assembly 120.

In addition, also referring to FIG. 3, another first full heat recovery working mode may additionally be provided when the refrigerant in the heat pump system flows in the direction as illustrated. At this time, a balance is reached between the heat to be absorbed for the evaporation of part of the indoor heat exchangers and the heat to be dissipated for the condensation of the other part of the indoor heat exchangers, so the heat exchange fan corresponding to the outdoor heat exchanger can be turned off, so that the outdoor heat exchanger is used only as a refrigerant flow path and no longer plays a role in heat exchange. The specific flow direction of the refrigerant in this working mode can be referred to the process described above in conjunction with FIG. 3, so it will not be described in detail here.

Figure 4:
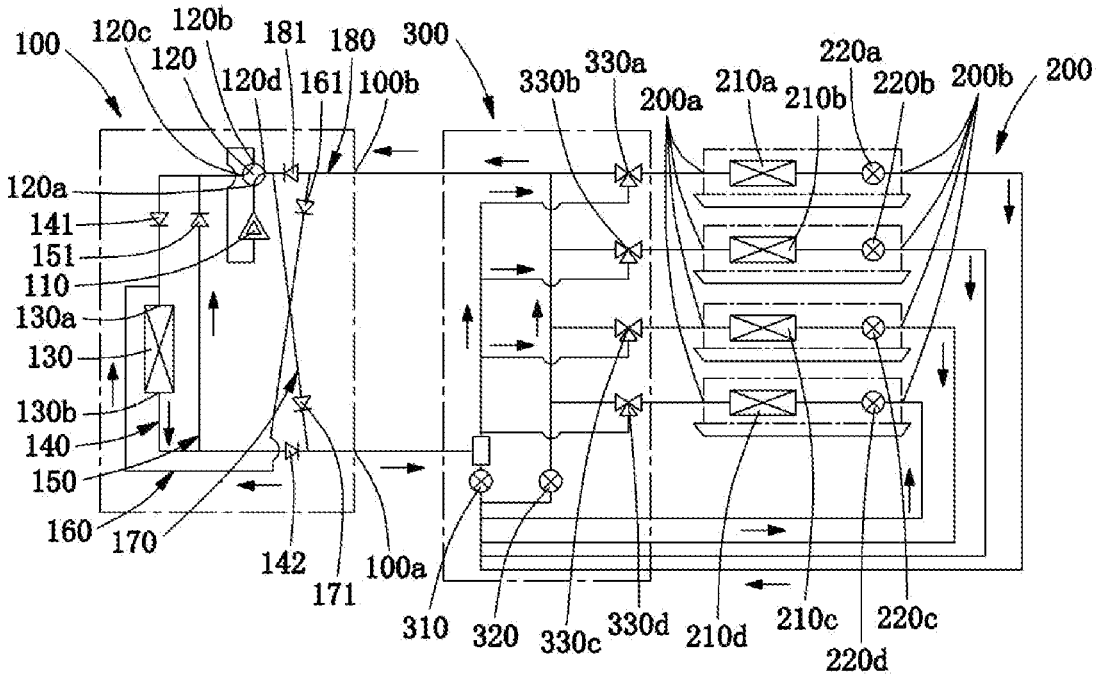
FIG. 4 is a schematic diagram of an embodiment of the heat pump system of the present application in a main heating mode.

Referring to FIG. 4, when the heat pump system operates the main heating mode, that is, part of the indoor heat exchangers in the indoor unit thereof operate the refrigeration mode, the other part of the indoor heat exchangers in the indoor unit thereof operate the heating mode, and the outdoor heat exchanger is used for heat absorption, in the outdoor unit, the switch valve assembly is adjusted to the first switch state. At this time, the first port 120*a* of the mode switch valve assembly 120 is connected to the fourth port 120*d*, and the second port 120*b* of the mode switch valve assembly 120 is connected to the third port 120*c*; in the heat exchange scheduling unit 300, the seventh switch valve assembly 310 and the eighth switch valve assembly 320 are turned off, and part of the three-way valve assemblies 330*a*, 330*b*, 330*c*, 330*d*, i.e., the three-way valve assemblies 330*a*, 330*b*, 330*c*, are switched to be connected to the third pipeline port 200*a* of the indoor heat exchangers 210*a*, 210*b*, 210*c* and the first pipeline port 100*a* of the outdoor unit, respectively, and the other part, i.e., the three-way valve assembly 330*d*, is switched to be connected to the third pipeline port 200*a* of the indoor heat exchanger 210*d* and the second pipeline port 100*b* of the outdoor unit, respectively. At this time, the high temperature and high pressure refrigerant discharged from the compressor 110 can flow into the docked heat exchange scheduling unit 300 and the indoor unit 200 through the mode switch valve assembly 120, the fifth check valve 171 and the first pipeline port 100*a*. The refrigerant flows into the indoor heat exchangers 210*a*, 210*b*, 210*c* through the three-way valve assemblies 330*a*, 330*b*, 330*c* and the third pipeline port 200*a* to be condensed and release heat. And, the refrigerant that has completed heating then flows from the fourth pipeline port 200*b* to the throttle assembly 220*d* for throttling expansion, and then enters the indoor heat exchanger 210*d* to be evaporated and absorb heat. The refrigerant that has completed refrigeration conditioning flows back to the outdoor unit 100 through the third pipeline port 200*a*, the three-way valve assembly 330*d* and the second pipeline port 100*b*. The refrigerant then flows into the outdoor heat exchanger 130 on the first branch 140 through the third check valve 161 on the third branch 160 in a predetermined direction to absorb heat, and the refrigerant that has absorbed heat flows back into the compressor through the second check valve 151 and the mode switch valve assembly 120.

In addition, also referring to FIG. 4, another second full heat recovery working mode may additionally be provided when the refrigerant in the heat pump system flows in the direction as illustrated. At this time, a balance is reached between the heat to be absorbed for the evaporation of part of the indoor heat exchangers and the heat to be dissipated for the condensation of the other part of the indoor heat exchangers, so the heat exchange fan corresponding to the outdoor heat exchanger can be turned off, so that the outdoor heat exchanger is used only as a refrigerant flow path and no longer plays a role in heat exchange. The specific flow direction of the refrigerant in this working mode can be referred to the process described above in conjunction with FIG. 4, so it will not be described in detail here.

The above examples mainly illustrate the outdoor unit and the heat pump system of the present invention. Although only some of the embodiments of the present invention have been described, those skilled in the art should understand that the present invention can, without departing from its spirit and scope, be implemented in many other forms. Therefore, the illustrated examples and embodiments are to be considered as illustrative but not restrictive, and the present invention may cover various modifications or replacements if not departed from the spirit and scope of the present invention as defined by the appended claims.

What is claimed is:

1. A heat pump system comprising:

an outdoor unit including:

a compressor, a mode switch valve assembly, an outdoor heat exchanger having a refrigerant inlet and a refrigerant outlet connected through pipelines, and a first pipeline port and a second pipeline port for docking with an indoor unit;

a first branch that connects the mode switch valve assembly and the first pipeline port, wherein the first branch is provided with the outdoor heat exchanger and a first switch valve assembly disposed on the refrigerant inlet side;

a second branch that connects the mode switch valve assembly and the first pipeline port, wherein the second branch is provided with a second switch valve assembly and is connected in parallel with the outdoor heat exchanger;

a third branch that connects the second pipeline port and the refrigerant inlet of the outdoor heat exchanger;

wherein, the first switch valve assembly and the second switch valve assembly are configured to control the on and off of the first branch and the second branch when the mode switch valve assembly arbitrarily switches the refrigerant flow direction, so that the refrigerant flows through the refrigerant inlet and the refrigerant outlet of the outdoor heat exchanger in sequence;

an indoor unit having indoor heat exchangers and throttle assemblies connected through pipelines, and a third pipeline port and a fourth pipeline port for docking with the outdoor unit;

a heat exchange scheduling unit having a seventh switch valve assembly and an eighth switch valve assembly connected in parallel, and a plurality of three-way valve assemblies;

wherein, each of the three-way valve assemblies is connected to the second pipeline port, the third pipeline port, and the first pipeline port, respectively;

the first end of the seventh switch valve assembly is connected to the fourth pipeline port, and the second end of the seventh switch valve assembly is connected between the plurality of three-way valve assemblies and the first pipeline port; and the first end of the eighth switch valve assembly is connected to the fourth pipeline port, and the second end of the eighth switch valve assembly is connected between the plurality of three-way valve assemblies and the second pipeline port.

2. The heat pump system according to claim 1, wherein:

in a first switch state of the mode switch valve assembly, the pipelines connect the compressor, the mode switch valve assembly, and the first pipeline port; and the pipelines connect the second pipeline port, the third branch, the outdoor heat exchanger inlet and the outdoor heat exchanger outlet on the first branch, the second branch, the mode switch valve assembly, and the compressor; and in a second switch state of the switch valve assembly, the pipelines connect the compressor, the mode switch valve assembly, the outdoor heat exchanger inlet and the outdoor heat exchanger outlet on the first branch, and the first pipeline port; and the pipelines connects the second pipeline port, the mode switch valve assembly, and the compressor.

3. The heat pump system according to claim 2, wherein:

the switch valve assembly has a first port connected to the exhaust port of the compressor, a second port connected to the suction port of the compressor, a third port connected to the outdoor heat exchanger, and a fourth port connected to the second pipeline port, wherein the first port is controlledly switched to be connected to the third port or the fourth port, and the second port is controlledly switched to be connected to the fourth port or the third port accordingly.

4. The heat pump system according to claim 1, further comprising:

a heat exchange fan arranged on a first side of the outdoor heat exchanger, wherein the refrigerant flow direction of the outdoor heat exchanger is arranged in a staggered manner with the flow direction of the air driven by the heat exchange fan, and the refrigerant outlet is closer to the upstream of the flow direction of the air driven by the heat exchange fan than the refrigerant inlet.

5. The heat pump system according to claim 4, wherein the outdoor heat exchanger is configured as a tube-fin heat exchanger.

6. The heat pump system according to claim 1, wherein the first switch valve assembly and the second switch valve assembly are configured as a first check valve and a second check valve with opposite stop directions.

7. The heat pump system according to claim 1, further comprising:

a third switch valve assembly further provided on the third branch, and a fourth switch valve assembly disposed on the refrigerant outlet side further provided on the first branch, wherein the fourth switch valve assembly and the third switch valve assembly are alternatively turned on;

a fourth branch that connects the mode switch valve assembly and the first pipeline port, wherein a fifth switch valve assembly is provided on the fourth branch; and a fifth branch that connects the mode switch valve assembly and the second pipeline port, wherein a sixth switch valve assembly is provided on the fifth branch, and wherein the fifth switch valve assembly and the sixth switch valve assembly are alternatively turned on.

8. The heat pump system according to claim 7, wherein the third switch valve assembly and the fourth switch valve assembly are configured as a third check valve and a fourth check valve with opposite stop directions; and/or the fifth switch valve assembly and the sixth switch valve assembly are configured as a fifth check valve and a sixth check valve with opposite stop directions.

* * * * *